US005743381A

United States Patent [19]

Patak et al.

[11] Patent Number: 5,743,381

[45] Date of Patent: Apr. 28, 1998

[54] APPARATUS FOR ILLUMINATING KEYBOARDS

[76] Inventors: Melvin Patak, P.O. Box 297, Ennis, Tex. 75120; Martin Sachs, 17 Dunbar Dr., Robbinsville, N.J. 08691

[21] Appl. No.: 819,475

[22] Filed: Mar. 17, 1997

[51] Int. Cl.[6] ..... H01H 9/00

[52] U.S. Cl. ..... 200/310; 200/DIG. 47

[58] Field of Search ..... 200/310, 311, 200/317, 312, 308, 309, DIG. 47

[56] References Cited

U.S. PATENT DOCUMENTS

| | | | |
|---|---|---|---|
| 3,213,269 | 10/1965 | Melvin et al. | 200/DIG. 47 |
| 3,619,591 | 11/1971 | Kerski | 200/DIG. 47 |
| 4,343,975 | 8/1982 | Sado | 200/310 |

*Primary Examiner*—David J. Walczak
*Attorney, Agent, or Firm*—Martin Sachs

[57] ABSTRACT

An apparatus for illuminating the keys on keyboards includes a relatively thin transparent material having a plurality of through apertures providing clearance for each of the keys of the keyboard that are to be received therein for illuimination. The surfaces and external edges of the relatively thin transparent material is treated to prevent light from escaping therefrom, with the internal edges of the clearance through apertures being left clear for permitting the light to excape therefrom, thereby illuminating each of the keys. A bracket is adapted to removably retained a light source in the thin transparent material and permits the orientation of the light rays emanating from the light source to enter into an edge of the relatively thin transparent material. The light source is coupled to an electrical power source power and includes a fuse and an on/off switch.

6 Claims, 1 Drawing Sheet

APPARATUS FOR ILLUMINATING KEYBOARDS

BACKGROUND OF THE INVENTION

1. Field of the Invention

The present invention relates generally to lighting sources and more particularly to an improved lighting apparatus for illuminating keyboards.

2. Description of the Relevant Art

There are numerous devices used to illuminate the keyboards of computers, calculators, portable telephones, etc., all of which require extensive modification of the keys of the device in order to properly illuminate them. The use of modified light arrangements emanating from the equipment or elsewhere are generally required to be installed at the time the manufacture of the device. Typical of these expensive modification is U.S. Pat. No. 5,408,060 issued to Murrinen on Apr. 18, 1995 which discloses a system for illuminating a keyboard in at least two different modes.

Another approach is disclosed in U.S. Pat. No. 5,138,119 issued to Demeo on Aug. 11, 1992, which requires a keyboard made of multi-layered material and conductive switches to provide the illumination all, of which is rather costly to manufacture.

The present apparatus overcomes the shortcomings of the prior art by providing a relatively inexpensive means for illuminating a keyboard, which may be utilized on the keyboard associated with computers are well as keyboards used in telephones and other devices.

SUMMARY OF THE INVENTION

Accordingly, the primary object of the present invention is to provide an inexpensive means for illuminating the keyboard of a computer or hand-held telephone.

Another object of the present invention is to provide an inexpensive illumination device which will illuminate the keyboard and will not increase the overall ambient lighting.

Yet another object of the present invention is to provide an after market apparatus that may be purchased by an individual after purchase of the original equipment to illuminate the keyboard.

It is still yet another object of the present invention to provide an inexpensive means for illuminating the keyboard of a computer or telephone, which may be manufactured and installed on a keyboard at the time of purchase.

It is still yet another object of the present invention to provide an inexpensive means for the manufactures of equipment to incorporate a device for illuminating the keyboard of the apparatus.

It is still yet another object of the present invention to provide a lighting apparatus for keyboards, which has its own power source, or alternatively, may be coupled to the source to which the keyboard is coupled.

The foregoing and other objects and advantages of the present invention will appear from the description to follow. In the description reference is made to the accompanying drawing, which forms a part hereof, and in which is shown by way of illustration a specific embodiment in which the invention may be practiced. This embodiment will be described in sufficient detail to enable those skilled in the art to practice the invention and it is to be understood that other embodiments may be utilized and structural change may be made without departing from the spiorit and scope of the invention. The following detailed description is, therefore, not to be taken in a limiting sense, and the scope of the present invention may be best described in the claims.

BRIEF DESCRIPTION OF THE DRAWINGS

In order that the invention may more fully be understood it will now be described by way of explanation, with reference to the accompanying drawing in which.

DESCRIPTION OF THE PREFERRED EMBODIMENT

Figure 1:
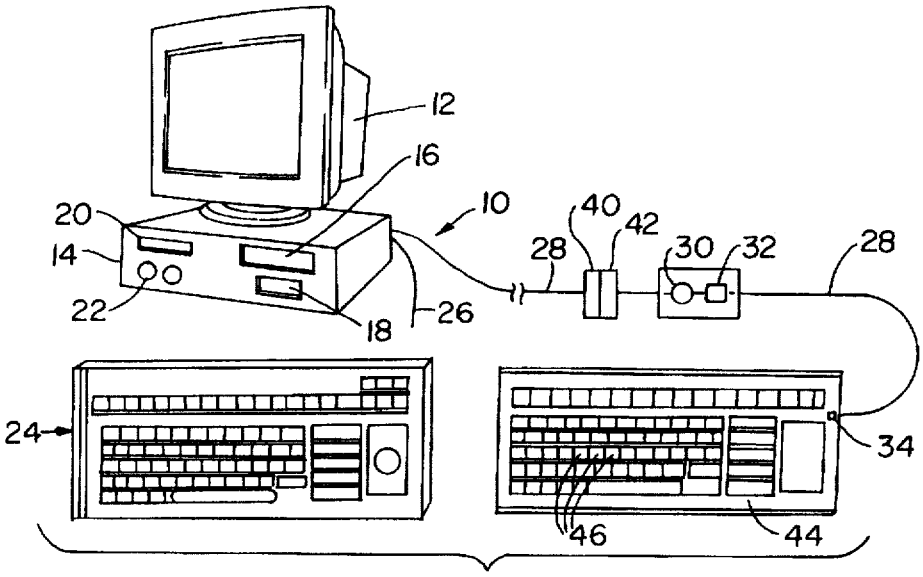
FIG. 1 is a pictorial representation, not to scale, of a computer with its associated keyboard and the illuminating keyboard apparatus, according to the principles of the present invention.
Figure 5:
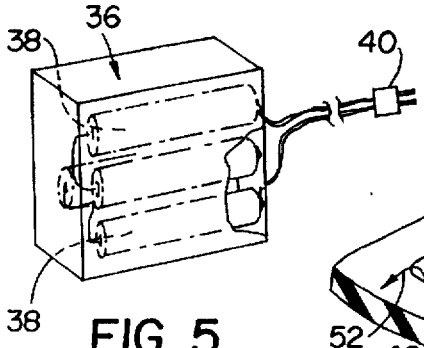
FIG. 5 is a pictorial representation of a battery pack assembly used for supplying energy to illuminate the light source.

Referring now to the figures, and particularly to FIG. 1, there is shown a typical computer system 10, which includes a display unit 12, a computer housing 14, which includes the typical items such as a floppy disk drive 16, a hard drive (not shown), a CD drive 18, a power switch 20 and indicator lights 22. In order to operate the computer, a typical computer keyboard 24 is connected thereto by means of a connection cable 26 that is connected into the rear of the computer housing 14 in a conventional manner. A second cable 28 is connected from the rear of the computer housing 14 through a series connected fuse 30 and a power on/off switch 32 that is connected to a light source 34, which may be a miniature light bulb capable of operating from a source of voltage between 5 to 12 volts, which the typical voltage appearing on the bus line to energize the printed circuit boards disposed within the computer housing 14. Connection to the computer housing bus line may be made by a typical printed card, not shown, inserted in one of the extra slots provided in the computer housing 14. Alternatively, a battery pack 36 (shown in FIG. 5) may contain either a single battery 38 or a plurality of low voltage units connected together, in a conventional manner, capable of supplying the voltage and current needed to maintain the proper illumination for the light source 34. The battery pack 36 may be supplied with a connector 40 that is connected to a mating connector 42 to be used to supply the voltage to the light source in lieu of the connection to the computer bus lines.

The keyboard illuminating apparatus 44 is provided with a plurality of apertures 46, which extend clear through the relatively thin transparent material 44 of which the keyboard illuminating apparatus is made. The material 44 has the dimensions so that the keys 48 and 50, shown in FIG. 4, fit through the apertures 46 with sufficient clearance so that the light rays 52 may exit along the edges 54, (see FIG. 3), surrounding each of the apertures 46 provided in the keyboard illuminating material 44 thereby illuminating the area around the keys 48. The edge 56 and the top and bottom surface of the keyboard illuminating apparatus 44 is made opaque by either painting or burnishing the edges so that the light trapped within the relatively transparent material 44 from which the keyboard illuminating apparatus is manufactured retains the light rays therein until it reaches the through apertures 46 surrounding the keys 48 and 50.

Figure 2:
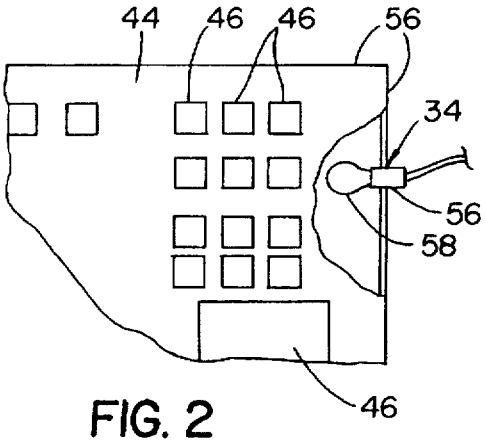
FIG. 2 is a top plan view, partially broken away, of a portion of the illuminating keyboard apparatus showing the insertion of a light source therein.
Figure 3:
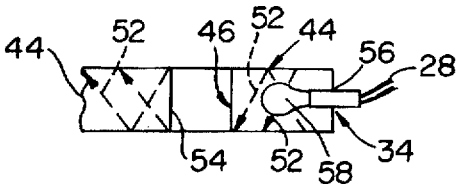
FIG. 3 is a cross-sectional view, in elevation, showing the path of light rays within the transparent material.

Referring now to FIGS. 2 and 3, the light source 34 is disposed within the keyboard illuminating apparatus 44 by means of a bracket 56 into which the actual light source or bulb 58 is placed. The bracket 56 retains the light bulb 58 in position so that the light rays 52 emanate therefrom and stay within the keyboard illuminating material 44, which may be manufactured from a transparent material such as Lucite or clear Lexan. Trademarks of a type of clear transparent polycarbonate material.

Figure 4:
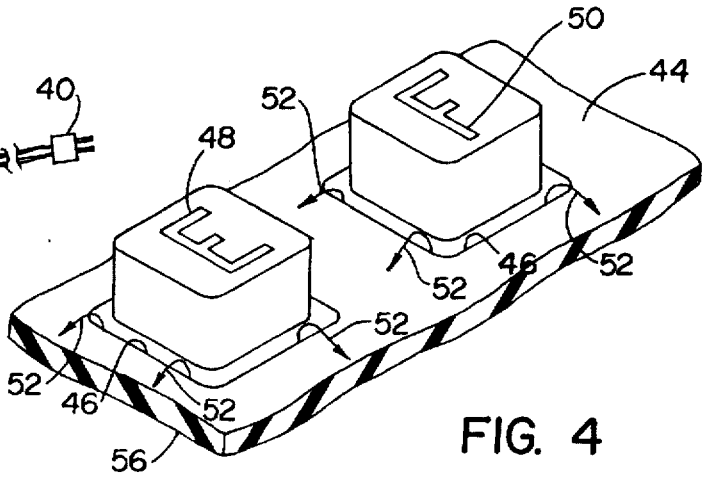
FIG. 4 is a greatly enlarged pictorial represention of the illuminating apparatus shown in FIG. 1.

The greately enlarged, partial pictorial representation shown in FIG. 4 displays how the light rays leave the material 44 thereby placing a glow around each of the keys 48 and 50 of the keyboard to be illuminated. It is anticipated that the keyboard illuminating apparatus is to be sold in the after sale market when individuals decide to have their keyboards illuminated for use in darkened work areas. However, the manufacturer of computers may decide that it would be an extreme advantage to provide this feature at the time the computer is sold. The use of the battery pack for illuminating the light source make it completely versatile for use on portable equipment.

Although a single light source has been described herein, it is to be clearly understood that the number of light sources to be used depends on the amount of light that the individual feels is necessary to reach the degree of illumination that he prefers on the keyboard. The number of lights to be used will be determined by the manufacture and the after sale market user.

In operation, the keyboard illuminating apparatus will be placed over the keyboard and is compatible thereto so that each of the keys would extend through the openings provided in the material 44. The battery pack 36 may be utilized for lighting the light bulb 58 or, as stated earlier, a connection may be made to a spare slot in the computer frame or housing 14 by means a printed circuit card, which may be coupled by means of cable 28 to the illuminating light source 34. The on/off switch 32 is used to turn on the illumination apparatus 44 as needed. The illuminating apparatus is protected by its own fuse and on/off switch so that if something went wrong with it, it would not harm the computer in any way.

Hereinbefore has been disclosed an apparatus for illuminating the keyboard of a computer and the like and may also be utilized in any other apparatus wherein it is desired to illuminate the keyboard in an inexpensive and reliable manner.

Having thus set forth the nature of the invention, what is claimed is:

1. An appartus adapted to overlie an existing keyboard for illuminating keys on the keyboard comprising:

A. a thin transparent material having;

a) a thickness, a top and bottom surface and external edges wherein light rays can pass throughout said thickness, b) a plurality of through apertures wherein each said aperture extends through said top and bottom surfaces, and wherein each said aperture being adapted to receive a key on the keyboard when said material is placed over the keyboard such that clearance is provided between the edges of the keys and edges of said through apertures;

c) said top and bottom surfaces and the external edges of said relatively thin transparent material being treated to prevent light from escaping therefrom, d) edges of said through apertures being left clear for permiting light to exit therefrom and into said clearance to illuminate each said keys;

B. at least one bracket means adapted to removably retain a light source, said bracket means being adapted to be retained on said material to permit light rays emanating from the light source to enter into a portion of said relatively thin transparent material;

C. a light source adapted to be received into said bracket means and positioned within said material; and D. coupling means, for coupling a source of electrical power to said light source.

2. An apparatus for illuminating keyboards, according to claim 1, wherein said source of electrical power is obtained from an apparatus to which the keyboard is coupled.

3. An apparatus for illuminating keyboards, according to claim 1, wherein said source of electrical power is obtained from a battery pack.

4. An apparatus for illuminating keyboards, according to claim 1, wherein said coupling means includes a fuse and a power on/off switch.

5. An apparatus for illuminating keyboards, according to claim 1, wherein said top and bottom surface and external edges of said transparent material are coated with a paint to prevent light rays from exiting therefrom.

6. An apparatus for illuminating keyboards, according to claim 1, wherein said top and bottom surface and external edges of said transparent material are burnished to prevent light rays from exiting therefrom.

* * * * *